US005314116A

United States Patent [19]

Krauth et al.

[11] Patent Number: 5,314,116

[45] Date of Patent: May 24, 1994

[54] PULSATOR FOR IRRIGATION SYSTEMS AND THE LIKE

[75] Inventors: Richard G. Krauth, Fresno; Steven P. Brunnengraeber, Clovis, both of Calif.

[73] Assignee: Wade Manufacturing Co., Tualatin, Oreg.

[21] Appl. No.: 28,406

[22] Filed: Mar. 9, 1993

Related U.S. Application Data

[63] Continuation of Ser. No. 822,998, Jan. 21, 1992, abandoned.

[51] Int. Cl.[5] ..... B05B 1/08

[52] U.S. Cl. ..... 239/99; 239/533.13

[58] Field of Search ..... 137/624.14; 239/99.61, 239/533.13, 570

[56] References Cited

U.S. PATENT DOCUMENTS

| | | | |
|---|---|---|---|
| 2,534,445 | 12/1950 | Hilkemeier | 239/533.13 |
| 3,739,952 | 6/1973 | Chafitz et al. | 222/213 |
| 3,902,664 | 9/1975 | Deines | 239/102 |
| 4,301,967 | 11/1981 | Hunter | 239/99 |
| 4,512,514 | 4/1985 | Elcott | 239/99 |
| 4,781,217 | 11/1988 | Rosenberg | 137/624.14 |
| 4,955,539 | 9/1990 | Ruttenberg | 239/1 |

FOREIGN PATENT DOCUMENTS 9204126 3/1992 PCT Int'l Appl. .

*Primary Examiner*—Andres Kashnikow
*Assistant Examiner*—Kevin Weldon
*Attorney, Agent, or Firm*—Phillips, Moore, Lempio & Finley

[57] ABSTRACT

A pulsator, adapted for use in irrigation and other systems requiring the uniform discharge of water or other liquids in intermittent pulses and at regular frequencies, comprises a casing having an expansible elastomeric tube disposed therein. The tube is adapted to be exposed to pressurized liquid for movement between contracted and expanded conditions of operation for controlling the intermittent opening of a valve, formed in part by the tube. A flow control, located at the inlet to the pulsator, functions to modulate the pressure of the incoming liquid to control the flow rate of the liquid communicated to an expansible chamber defined in part by the tube. When the pressure in the chamber exceeds a predetermined level, the valve will open to intermittently discharge pulses of liquid to a distributor, such as an irrigation sprayer. The pulsator is preferably structured to insure continuous communication of liquid from the inlet to the pulsator to the chamber. Further, the normally closed valve preferably comprises an annular contact surface defined circumferentially on an annular flange that normally engages the tube in at least near line contact to induce near-instantaneous opening of the valve during a pulsating cycle.

20 Claims, 2 Drawing Sheets

PULSATOR FOR IRRIGATION SYSTEMS AND THE LIKE

CROSS-REFERENCE TO RELATED APPLICATION

This application is a continuation of U.S. patent application Ser. No. 07/822,998, filed on Jan. 21, 1992 and now abandoned.

TECHNICAL FIELD

This invention relates to a pulsating device for discharging a liquid intermittently and, more particularly, to a pulsating device adapted to intermittently discharge a liquid at regular frequencies and uniform discharges for irrigation and other purposes.

BACKGROUND OF THE INVENTION

Water distributing devices, such as fixed sprayers used for irrigation purposes, are limited in respect to the distances at which spray patterns can be discharged. Further, conventional sprayers are incapable of functioning in the desired manner when they are supplied with water at relatively low mainline pressures, such as below 25 psi. Thus, conventional sprayers and other water distributing devices cannot be retro-fitted to systems working under marginal pressure levels provided by existing pumps, mainlines, and sub-mainline infrastructures. The alternative to converting marginal systems of this type to include pumps or other accessories for boosting pressures to an acceptable working level, would be cost prohibitive and impracticable.

A proposed solution to these problems has been the advent of pulsating devices, adapted to discharge water from an irrigation sprayer at greater distances then can be achieved with conventional sprayers. For example, U.S. Pat. No. 4,301,967 discloses a pulsating-type sprinkler system wherein an elastomeric tube or bladder intermittently expands and contracts to control the opening and closing, respectively, of a valve to discharge water in intermittent pulses. U.S. Pat. No. 4,781,217 discloses a pulsating-type irrigation system that relies on an expandable (FIG. 1) or fixed volume container (FIG. 4) for receiving fluid via a fixed orifice to provide intermittent pulses of water under control of a spring-biased and separate check valve. U.S. Pat. No. 4,955,539 discloses a similar system wherein a rigid container is utilized to receive pressure-compensated water and thereafter discharge the water in intermittent pulses under the control of a pre-set check valve comprising an expansible elastomeric sleeve.

Pulsating devices of the type described above must necessarily function within very narrow flow and line pressure ranges to be practicable. Further, such systems are normally incapable of operating efficiently at relatively low line pressures, e.g., below 25 psi. In addition, the systems are prone to one or more of the following problems: Inconsistent start-up to initiate a pulsating cycle; utilization of discharge orifices having different sizes that properly function at varied flow rates, even within narrow ranges; a tendency to randomly stop or emit a steady (non-intermittent) stream of water when placed in operation; a tendency to emit a steady stream of water, rather than intermittent pulses, when operated at relatively high flow rates and/or pressures; and inability to continuously and cyclically provide for the uniform discharge of water at regular frequencies.

SUMMARY OF THE INVENTION

An object to this invention is to overcome the above, briefly described problems by providing an economical and highly efficient pulsator, particularly adapted for use in irrigation systems for uniformly discharging water or other liquids in intermittent pulses and at regular frequencies.

The preferred pulsator embodiment of this invention comprises an inlet, an outlet, a casing, and an expansible and contractible elastomeric tube in the pulsator. The tube is adapted to be pressurized for movement from a normal first position closing a valve to a second position for intermittently opening the valve to discharge liquid from the outlet of the pulsator at at least substantially regular frequencies and uniform discharges in response to the pressure of the liquid in the tube exceeding a predetermined level. A self-modulating flow control, located at the inlet to the pulsator, modulates the pressure of the liquid received from a pressurized source to control the flow rate of the liquid into the tube and to insure the uniform discharge of the liquid at regular frequencies. The flow control enables the pulsator to be used with systems operating over a wide range of mainline pressures, e.g., 15 psi to 100 psi.

In another aspect of this invention, an inlet to an expansible chamber, defined within the tube, is structured to continuously communicate liquid from the pulsator inlet and into the chamber when the tube is in its contracted condition to alleviate air-contamination and related problems of the type described above.

In still another aspect of this invention, the normally closed valve comprises a annular contact surface defined on an annular flange of a mounting member for the tube that is normally engaged in at least near line contact by the tube when the tube is in its contracted condition whereby near-instantaneous opening of the valve is induced.

A further aspect of this invention comprises at least one slot defined in the mounting member for continuously communicating liquid to an inlet side of the valve to further induce near-instantaneous opening and discharge of liquid through the valve in response to expansion of the tube.

BRIEF DESCRIPTION OF THE DRAWINGS

Other objects and advantages of this invention will become apparent from the following description and accompanying drawings wherein.

DESCRIPTION OF THE PREFERRED EMBODIMENTS

General Description

Figure 1:
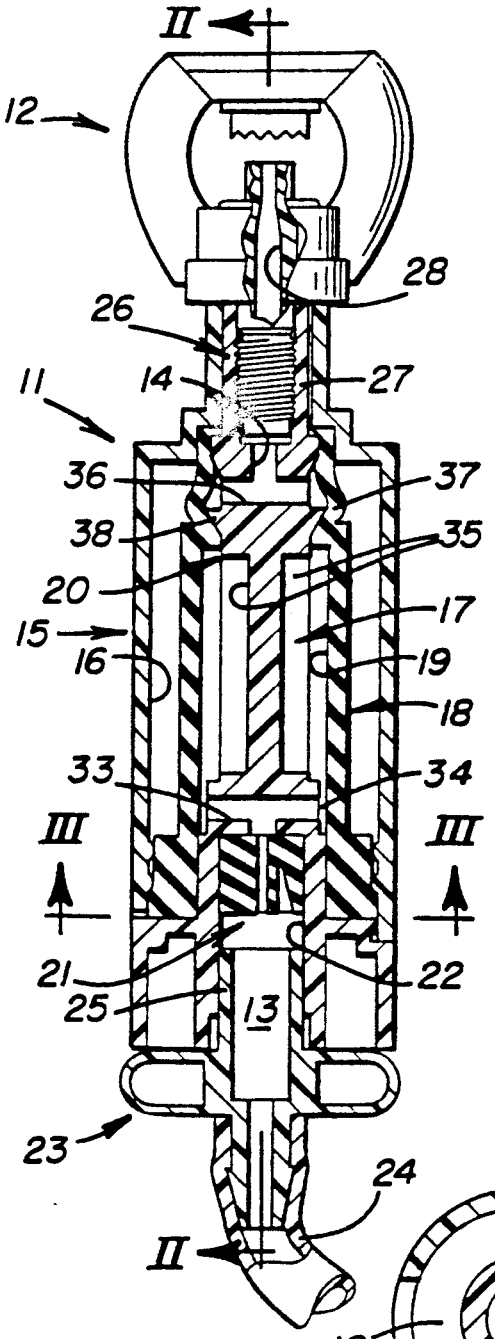
FIG. 1 is a partially sectioned view, generally in longitudinal section, illustrating an irrigation system of this invention including a pulsator shown in its neutral or non-pressurized condition of operation an adapted to be pressurized to discharge intermittent pulses of a liquid therefrom.
Figure 2:
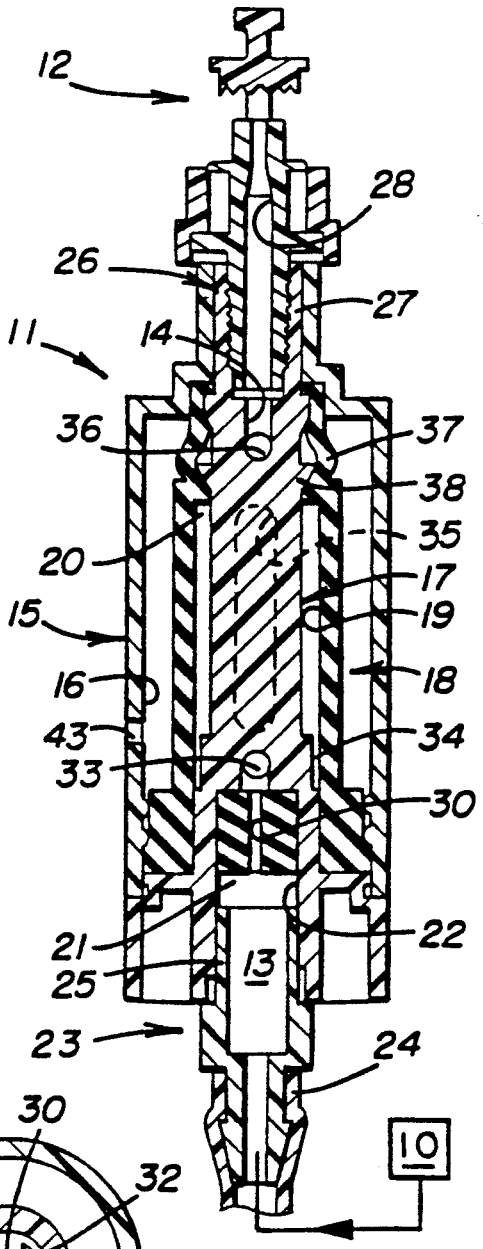
FIG. 2 is a longitudinal sectional view through the pulsator, taken in the direction of arrows II—II in FIG. 1.

FIGS. 1 and 2 illustrate an irrigation system comprising a source 10 of pressurized liquid, such as a mainline adapted to communicate pressurized water in the range of from 15 psi to 100 psi to a pulsator 11. The pulsator, shown in its neutral or non-pressurized condition of operation, is adapted to discharge liquid through a distributor 12, such as a conventional 360° fixed sprayer, in intermittent pulses therefrom. In particular, a pulsator inlet 13 is adapted to supply the pressurized liquid to the pulsator which then functions to discharge the liquid through a pulsator outlet 14 and to the sprayer in intermittent pulses and at at least substantially regular frequencies and uniform discharges.

Figure 6:
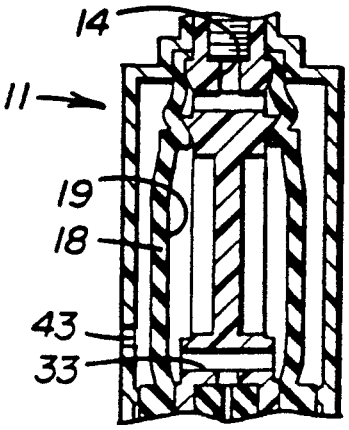

The pulsator further comprises a rigid casing 15, defining a cavity 16 therein, and a rigid mounting member or insert 17 disposed in the cavity and having its centrally disposed major body portion spaced inwardly from the casing. During operation, an elastomeric tube 18, defining an expansible chamber 19 therein, is adapted for radial outward movement from its normally contracted condition when the chamber is being charged with pressurized liquid during the initiation of a pulsating cycle (FIG. 6). Opposite ends of the tube are clamping and thus fixedly attached between casing 15 and member 17. A flow control, of the type described in U.S. Pat. No. 4,909,441, is connected between inlet 13 and chamber 19 to modulate liquid pressure to control the flow rate of the liquid into the chamber.

Figure 4:
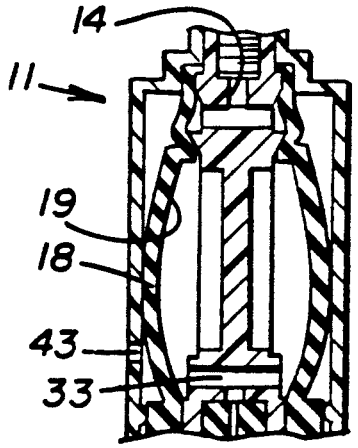
FIGS. 4–6 sequentially illustrate pressurized, discharge and recharging conditions of the pulsator during operation thereof.
Figure 8:
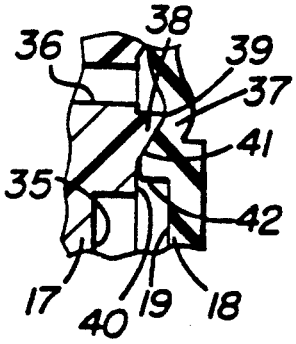
FIG. 8 is an enlarged cross-sectional view partially illustrating a valve of the pulsator, as shown in its FIG. 1 neutral condition.
Figure 5:
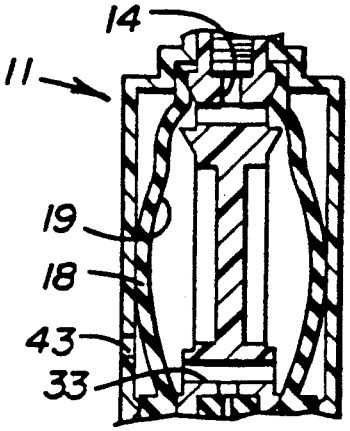
Figure 9:
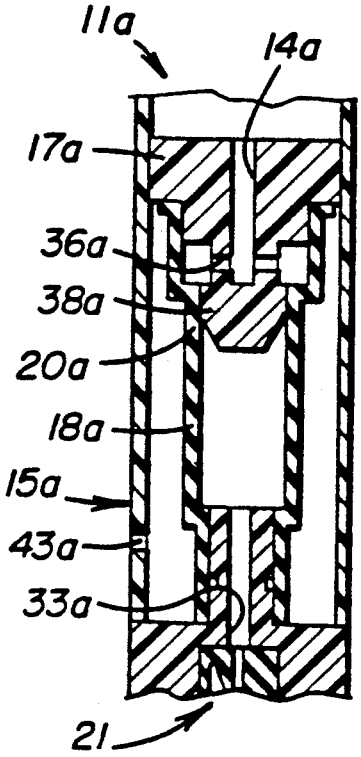
FIG. 9 is a partial longitudinal sectional view illustrating a second embodiment of the pulsator and FIG. 10 is a partial longitudinal sectional view illustrating a third embodiment of the pulsator.

A normally closed valve 20 is defined between member 17 and engaged portions of tube 18 for intermittently opening (FIG. 5) to discharge liquid from chamber 19 and through pulsator outlet 14. The liquid is discharged in intermittent pulses in response to the pressure of the liquid in the chamber intermittently exceeding a predetermined pressure level (e.g., 15 psi). FIGS. 4–6 sequentially illustrate the pulsator in its fully pressurized, discharge and recharging conditions of operation, respectively. FIGS. 8 and 9 illustrate additional embodiments of this invention, described in detail hereinafter. Although the latter embodiments are less preferred, they are each capable of operation under particular system pressures and flow rates.

As discussed above, prior art pulsating devices, particularly those intended for use in irrigation systems, are designed to function only within a very narrow range of flow rates and line pressures, e.g., within a total range approximating 10 psi. In contrast thereto, the preferred pulsator of this invention (FIG. 1) is capable of efficient operation over a wide pressure range (e.g., 15 psi to 100 psi) and accompanying flow rates. The pulsator also exhibits consistent start-up to initiate a pulsating cycle, avoids the need for the burdensome task of installing various sizes of discharge orifices to efficiently function at varied flow rates, exhibits highly efficient and repeatable pulsating cycles without tending to periodically stop or emit a steady stream of water, particularly when operated at relatively high flow rates and/or pressures, and continuously provides for the uniform discharge of water at regular frequencies.

It will become obvious to those skilled in the art that the pulsator of this invention can be used to emit liquids other than water (e.g., liquid fertilizer mixtures). Further, the pulsator teachings of this invention can be commercially applied to other systems requiring pulsating cycles for intermittently discharging liquids, such as pulsating shower heads, pulsating fire prevention systems, and other types of systems requiring the intermittent discharge of a liquid.

Further, the pulsator can be "sized-up" for commercial applications, adapted to work under substantially higher mainline pressure levels and/or flow rates than those described herein for particular application to agricultural-type irrigation systems. As suggested above, the pulsator of this invention is capable of efficiently operating over wide ranges of pressure levels (e.g., 15 psi to 100 psi) and flow rates (e.g., 0.5 GPH to 10.0 GPH) without requiring modification or change to any of the components of the pulsator. The latter desiderata is a distinct advantage in the commercial marketplace.

Detailed Description

Figure 7:
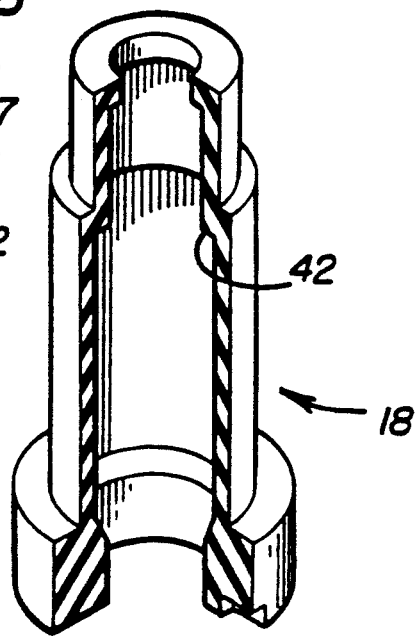
FIG. 7 is an enlarged and partially sectioned isometric view illustrating an expansible elastomeric tube in its pre-installed, relaxed condition prior to its forming a part of the pulsator combination.

Referring to FIGS. 1–3, 7 and 8, the majority of component parts of pulsator 11 are at least generally circular in transverse cross-section (FIG. 3) and are adapted for expeditious assembly. In particular, tube 18, shown in its relaxed and pre-installed condition (generally cylindrical) in FIG. 7, is stretched over member 17 and normally retracts to initially assume its neutral condition shown in FIG. 1. Elastomeric flow control 21 is then inserted and closely fitted into an accommodating bore 22, defined at the upstream or inlet end of member 17, and the completed sub-assembly is inserted into casing 15.

A suitably configured adapter 23 couples an inlet line 24 to member 17 by inserting a cylindrical extension 25 into press-fit relationship within bore 22. A threaded stem 26 of distributor 12 is suitably attached to an internally threaded cylindrical neck 27 of member 17 to communicate water or other suitable liquid from pulsator outlet 14 to an outlet passage 28 of the distributor. Other types of distributing devices, such as rotary sprayers, fixed jets, or the like, can be used with pulsator 11, as will be appreciated by those skilled in the irrigation arts.

Figure 3:
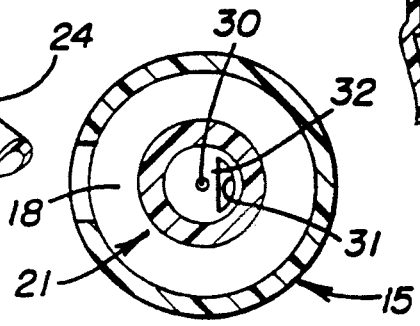
FIG. 3 is transverse cross-sectional view through the pulsator, taken in the direction of arrows III—III in FIG. 1.

Flow control 21 is preferably of the type fully described in U.S. Pat. No. 4,909,441, the disclosure of which is incorporated by reference herein. As shown in FIGS. 1 and 3, the elastomeric and generally cylindrically shaped flow control comprises a centrally disposed flow passage 30, a sub-chamber 31 and a flexible diaphragm 32 separating the flow passage from the sub-chamber. In operation, diaphragm 32 flexes into and cooperates with flow passage 30 to vary the cross-sectional area of the passage in response to pressure fluctuations in sub-chamber 31. The pressure-modulating flow control functions in cooperation with the variable pressures occurring in expansible chamber 19 to modulate the pressure of the liquid at pulsator inlet 13 to control the flow rate of the liquid into the chamber whereby the pulsator is adapted to function over wide ranges of pressure levels and flow rates in an efficient and repeatable manner.

The elastomeric material composing both flow control 21 (DOW 598) and tube 18 (DOW 595) is preferably a Silastic material (LSR or liquid silicone rubber purchased from Dow-Chemical Corporation in liquid form) having the following basic ranges of physical and mechanical properties, resulting from the specified treatments to the supplied liquid:

| PROPERTY | MOLDED (INJ.) (30 sec. @ 200° C.) | POST-CURED (4 hrs. @ 200° C.) | HEAT-AGED (240 hrs. @ 200° C.) |
|---|---|---|---|
| DUROMETER (SHORE "A") | 40–65 | 44–70 | 50–75 |
| TENSILE STRENGTH | 8.5–9.0 MPa | 8.008.5 MPa | 7.0–7.5 MPa |
| ELONGATION | 450–600% | 300–400% | 225–350% |
| TEAR STRENGTH (Die "B") | 35–45 kN/m | 26–55 kN/m | 13.2–21.1 kN/m |
| MODULUS (@ 100%) | 1.0–2.5 MPa | — | — |
| RESILIENCE (BASHORE) | 35–55 | 35–55 | — |
| COMPRESSION SET (22 hrs. @ 175° C.) (ASTM D395 METHOD B) | 50–60 | 15–25 | — |

The remaining components are preferably composed of standard rigid or semi-rigid plastic materials well-known to those skilled in the art. For example, casing 15 and member 17 may be composed of a standard polypropylene material whereas adapter 23 may be composed of polycarbonate.

As further shown in FIG. 1, an inlet is provided for continuously communicating pressurized liquid from flow control 21 to chamber 19 when the tube is in its contracted condition closing valve 20. In the embodiment illustrated, the inlet comprises an inlet port 33 defined in member 17 and having a inlet side thereof continuously communicating with the outlet of passage 30 (FIG. 3) of the flow control. The branched pair of outlets from port 33 are continuously positioned in out-of-contact relationship with tube 18, even when the tube is in its fully contracted neutral condition shown in FIG. 1, to define an annular clearance or space 34 between member 17 and the tube continuously communicating inlet port 33 with chamber 19.

As further shown in FIG. 1, at least one slot 35 is defined in mounting member 17 to be continuously exposed to chamber 19 for openly communicating liquid from clearance 34 directly to an inlet or upstream side of valve 20. The slot is formed longitudinally in member 17 to extend at least substantially the full length of chamber 19. In the embodiment illustrated, mounting member 17 comprises a generally tubular pin and a pair of diametrically opposed slots 35 are formed on opposite sides of the pin.

Referring to FIGS. 1 and 2, a bifurcated outlet port 36 is defined at the downstream end of member 17 for communicating the pulsed pressurized liquid from chamber 19 to pulsator outlet 14 when tube 18 is in its fully expanded condition (FIG. 5) to open valve 20. Valve 20 comprises an end portion 37 of tube 18 that normally compresses against and engages underlying surface portions of member 17. The tube thus normally covers upstream and downstream sides of the inlet to outlet port 36 when the tube is in its various and at least partially contracted conditions illustrated in FIGS. 1, 2, 4 and 6. The tube exhibits sufficient flexibility to uncover the inlet to outlet port 36 when the tube is in its fully expanded condition (FIG. 5), opening valve 20 to communicate chamber 19 with outlet port 36 and thus pulsator outlet 14.

As more clearly shown in FIG. 8, a circumferentially extending and annular flange 38 is formed on member 17 to define an annular contact surface 39. The contact surface is preferably ultra smooth and uniform and is positioned on the upstream side of the inlet to outlet port 36 to be normally engaged in at least near line contact by the tube when the tube is in a retracted and sealing condition. In the embodiment illustrated, flange 38 is at least generally wedge-shaped, when viewed in cross-section.

A major diameter, at a slightly rounded apex of the wedge-shaped flange, in part defines contact surface 39 that engage tube 18 in near line contact. Contact surface 39 insures that tube 18 will release therefrom and reseat thereon in a uniform manner, circumferentially about the contact surface. This quick-release function promotes the release of any air that ma have accumulated in the system in the vicinity of valve 20.

As further shown in FIG. 8, the flange terminates at its lower end at a contiguous non-contact surface 40, spaced longitudinally downwardly from contact surface 39 and defined by a minor diameter of the flange less than the major diameter defined at the apex of contact surface 39. An at least generally frusto-conically shaped surface 41 of the flange is connected between and intersects surfaces 39 and 40. The above-described arrangement induces a near-instantaneous, but smooth, transitional opening of valve 20 when the pressure in chamber 19 exceeds a predetermined pressure level (e.g., 15 psi), required to open valve 20 fully (FIG. 5).

Otherwise stated, surface 40, adjacent to the lower termination of flange 38, is continuously exposed to the pressure in chamber 19 and is continuously maintained essentially in out-of-contact relationship with respect to overlying end portion 37 of tube 18. An annular undercut portion 42 is defined internally on tube 18 to provide sufficient clearance to aid in providing this continuous non-contacting relationship, closely adjacent to the upstream end of flange 38, between member 17 and the tube. Thus, a near-instantaneous communication of pressurized fluid from chamber 19 to valve 20 is induced, with the further aid of slots 35, when the tube begins to expand (FIG. 4) towards its fully expanded condition (FIG. 5) to open the valve. A vent hole 43 (FIG. 2) is formed through a sidewall of casing 15 to continuously vent cavity 16 to ambient air pressure.

Figure 10:
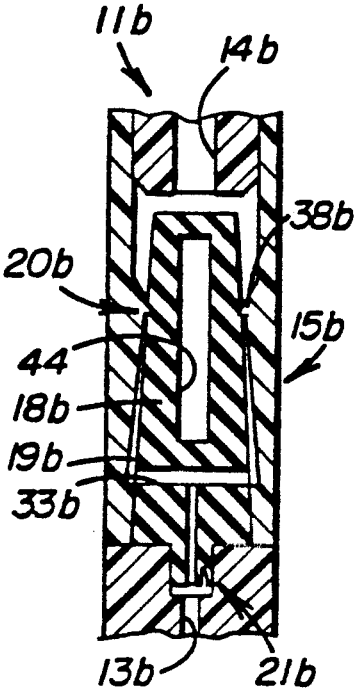

The following dimensions were incorporated into one specific embodiment of pulsator 11:

Casing 15 (Major O.D.)=2.10 cm
- Major O.D.=1.37 cm
- Wall Thickness=0.18 cm Member 17:
- Surface 39 (O.D.)=0.99 cm
- Pulsator Outlet 14 (I.D.)=0.20 cm
- Outlet Port 36 (I.D.)=0.20 cm
- Inlet Port 33 (I.D.)=0.20 cm
- Depth of Slot(s) 35=0.25 cm
- Depth of Clearance 34=0.05 cm FIGS. 9 and 10 illustrate additional pulsator embodiments 11*a* and 11*b*, respectively, wherein identical numerals depict corresponding components and constructions. It should be understood that these embodiments of the pulsator are adapted to be incorporated into an irrigation system of the type described above or other apparatus or systems wherein the use of a pulsator is required.

As shown in FIG. 9, pulsator 11*a* comprises above-described flow control 21 at the pulsator inlet, a pulsator outlet 14*a*, a rigid cylindrical casing 15*a* and a tubular mounting member 17*a* reciprocally mounted in the casing. A first end of an elastomeric tube 18*a*, composed of a material similar to that of tube 18, has its first end fixedly attached to the casing adjacent to flow control 21. The second end of the tube is fixedly attached to reciprocal mounting member 17*a*.

Thus, pressurized liquid is adapted to be communicated to an expansible chamber 19*a*, defined in tube 18*a*, via a passage 33*a* to intermittently expand and simultaneously elongate the tube. After the pressure exceeds a predetermined level (e.g., 15 psi), a valve 20*a*, defined between a flange 38*a* of mounting member 17*a* and tube 18*a*, will open. Intermittently pulsed water will thus be communicated to outlet 14*a* via a pair of diametrically opposed ports 36*a* whereafter the tube will contract radially and retract longitudinally to close valve 20*a*.

Pulsator 11*b* of FIG. 10 comprises an expansible chamber 19*b*, defined between a casing 15*b* and an elastomeric tube 18*b*. The tube is adapted for movement from its relaxed or normally expanded condition shown in FIG. 10 to a compressed or contracted condition when the chamber is pressurized. Pressurized liquid from a mainline (not shown) is communicated to chamber 19*b* via a pulsator inlet 13*b*, a flow control 21*b* and an inlet port 33*b*, defined in the tube.

The elastomeric tube is closed at both ends to define a closed cylindrical chamber 44 therein that aids in inducing compression of the tube to open a valve 20*b* when the pressure in chamber 19*b* exceeds a predetermined pressure level (e.g.,. 15 psi). The valve comprises an annular flange 38*b*, formed internally on casing 15*b*, adapted to engage and compress opposed outer surface portions of the tube to form a static seal thereat in generally the same manner as provided by above-described flange 38 (FIG. 8). In this embodiment, flow control 21*b*, functioning identical to above-described flow control 21, is molded to form an integral part of tube 18*b*.

In operation of the FIGS. 1–8 embodiment, pressurized fluid source 10, such as a common mainline supplying the pulsator with pressurized water or other liquid within a range of from 15 psi to 100 psi, communicates the liquid from pulsator inlet 13 to flow control 21 to initiate the charging state of a pulsating cycle (FIG. 6). The flow control functions to modulate the pressure and flow rate of the liquid communicated to chamber 19 in the general manner described in above-referenced U.S. Pat. No. 4,909,441. As shown in FIG. 4, the pressure level in the chamber builds-up and, when a predetermined pressure level (e.g., 15 psi) is exceeded, valve 20 will open (FIG. 5) to discharge the pulsed water to distributor 12 (FIG. 1). The engagement of expanded tube 18 with housing 15 during the opening stage of the pulsating cycle delimits further expansion of the tube and aids in the quick-opening of valve 20.

Upon relief of the pressure in chamber 19, the tube will collapse and contract to close valve 20 whereby recharging of the chamber with pressurized liquid is again initiated (FIG. 6). As described above, the pulsator functions to discharge liquid at at least substantially regular frequencies and uniform discharges or pulses for irrigation purposes. The spray pattern emitted from distributor 12 can be varied for a particular pulsator application by varying dimensional parameters of the component parts of the pulsator and/or the compositional make-up of tube 18, as will be appreciated by those skilled in the art.

Pulsator 11*a* of FIG. 9 functions in a generally similar manner in that modulated pressurized fluid is continuously communicated to expansible chamber 19*a* to periodically open valve 20*a* for repetitive pulsating cycles. If so desired, an annular flange, similar to flange 38, could be formed externally on member 17*a* to induce a more precise and near-instantaneous opening of valve 20*a*, as described above (FIG. 8). Pulsator 11*b* functions similar, but in somewhat a reverse manner, to pulsators 11 and 11*a* in that flow control 21*b* will modulate fluid pressure and flow of the incoming pressurized liquid to expansible chamber 19*b* which controls the compression of tube 18*b* and opening of valve 20*b* for pulsating purposes. Flange 38*b* can also be formed in a manner similar to flange 38 to effect near-instantaneous opening of the valve.

We claim:

1. In a pulsator comprising a pulsator inlet for receiving pressurized liquid therein, a pulsator outlet adapted to discharge liquid in intermittent pulses therefrom, a mounting member, an elastomeric tube means, disposed on said mounting member and defining an expansible chamber therebetween, for movement from a normal contracted condition when the pressure of the liquid in said chamber falls below a predetermined level to an expanded condition when the pressure of the liquid in said chamber exceeds said level, and valve means for closing when said tube means is in its contracted condition and for intermittently opening when said tube means is in its expanded condition to discharge liquid from said chamber through said pulsator outlet in aid intermittent pulses in response to the pressure of the liquid in said chamber intermittently exceeding said level, and inlet means for continuously and unobstructively communicating liquid from said pulsator inlet and into said chamber when said tube means is in both its contracted condition closing said valve means and its expanded condition opening said valve means, including an annular clearance defined radially between said mounting member and said tube means in surrounding relationship relative to said pulsator inlet and wherein said valve means comprises said tube means engaging said mounting member in at least near line contact when said tube means is in its contracted condition closing communication of said chamber with said pulsator outlet, and slot means defined radially between said mounting member and said tube means to be continuously exposed to said chamber for continuously communicating liquid from said inlet means to an inlet side of said valve means.

2. The pulsator of claim 1 wherein said inlet means further comprises an inlet port defined in said mounting member and having an inlet thereof continuously communicating with said pulsator inlet and further having an outlet thereof continuously positioned in out-of-contact relationship with respect to said tube means at said annular clearance for continuously and unobstructively communicating said inlet port with said chamber when said tube means is in its contracted condition closing said valve means.

3. The pulsator of claim 1 further comprising slot means defined in said mounting member to be continuously exposed to said chamber for continuously communicating liquid from said inlet means to an inlet side of said valve means.

4. The pulsator of claim 1 further comprising an outlet port means, having an inlet adapted to communicate with said chamber and an outlet communicating with said pulsator outlet, for communicating liquid from said chamber to said pulsator outlet when said tube means is in its expanded condition, said valve means comprising a first portion of said tube means covering upstream and downstream sides of the inlet to said outlet port means when said tube means is in its contracted condition and having sufficient flexibility to uncover the inlet to said outlet port means when said tube means is in its expanded condition, and an annular flange defining an annular contacting surface positioned on the upstream side of the inlet to said outlet port means and normally engaged in at least near line contact by the first portion of said tube means when said tube means is in its contracted condition.

5. The pulsator of claim 4 wherein said contacting surface is defined at a major diameter of said flange and further comprising a contiguous non-contacting surface spaced longitudinally from said contacting surface to be continuously exposed to said chamber and defined at a minor diameter at said flange, less than said major diameter, a second portion of said tube means being continuously retained in out-of-contact relationship with respect to said non-contacting surface when said tube means is in its contracted condition to induce an immediate communication of pressurized liquid from s id chamber to the upstream side of inlet to said outlet port when said tube means begins to expand towards its fully expanded condition to open said valve means.

6. In an irrigation system comprising a source of pressurized liquid, a distributor for discharging said liquid intermittently therefrom and a pulsator connected between said source and said distributor, said pulsator comprising a pulsator inlet for receiving pressurized liquid thereof from said source, a pulsator outlet for emitting said liquid in intermittent pulses to said distributor, a casing defining a cavity therein, a mounting member disposed in said cavity, an elastomeric tube means, defining an expansible chamber therein and disposed between said casing and said mounting member, for movement from a normally contracted condition when the pressure of the liquid in said chamber falls below a predetermined level to an expanded condition when the pressure of the liquid in said chamber exceeds said predetermined level, flow control means between said pulsator inlet and said chamber for controlling the flow rate of said liquid into said chamber, valve means, normally closed when said tube means is in its contracted condition and defined between said mounting member and said tube means, for intermittently opening to discharge liquid from said chamber through said pulsator outlet in said intermittent pulses at at least substantially regular frequencies and uniform discharges in response to the pressure of the liquid in said chamber intermittently exceeding said predetermined level, inlet means, including an annular clearance defined between said mounting member and said tube means for continuously and unobstructively communicating liquid directly from said flow control means and into said chamber when said tube means is in both its contracted condition closing said valve means, and its expanded condition, and slot means defined radially between said mounting member and said tube means to be continuously exposed to said chamber for continuously communicating liquid from said inlet means to an inlet side of said valve means.

7. The irrigation system of claim 6 wherein said inlet means comprises an inlet port defined in said mounting member and having an inlet thereof continuously communicating with said flow control means and further having an outlet thereof continuously positioned in out-of-contact relationship with respect to said tube means to define said annular clearance between said mounting member and said tube means continuously communicating said inlet port with said chamber when said tube means is in its contracted condition.

8. The irrigation system of claim 6 wherein said slot means comprises at least one slot formed in said mounting member to extend at least substantially the full length of said chamber.

9. The irrigation system of claim 8 wherein said mounting member comprises a generally tubular pin and wherein said slot means comprises a pair of diametrically opposed and longitudinally extending slots formed on opposite sides of said pin.

10. The irrigation system of claim 6 further comprising an outlet port, having an inlet adapted to communicate with said chamber and an outlet communicating with said pulsator outlet, defined in said mounting member for communicating liquid from said chamber to said pulsator outlet when said tube means is in its expanded condition, said valve means comprising a first portion of said tube means that normally engages said mounting member to cover upstream and downstream sides of the inlet to said outlet port when said tube means is in its contracted condition and having sufficient flexibility to disengage said mounting member of the upstream side of said inlet to uncover the inlet to said outlet port when said tube means is in its expanded condition, and an annular flange on said mounting member defining an annular contacting surface positioned on the upstream side of the inlet to said outlet port and normally engaged in at least near line contact with the first portion of by said tube means when said tube means is in its contracted condition.

11. The irrigation system of claim 10 wherein said contacting surface is defined at a major diameter of said flange and further comprising a contiguous non-contacting surface spaced longitudinally from said contacting surface to be continuously exposed to said chamber and defined by a minor diameter at said flange, less than said major diameter, a second portion of said tube means being continuously retained in out-of-contact relationship with respect to said non-contacting surface when said tube means is in its contracted condition to include a near-instantaneous communication of pressurized liquid from said chamber to the upstream side of the inlet to said outlet port and through said valve means when said tube means expands towards its expanded condition to open said valve means.

12. The irrigation system of claim 11 wherein said flange further comprises an at least generally frustoconically shaped surface between said contacting and non-contacting surfaces.

13. The irrigation system of claim 6 wherein each of said casing and said tube means are generally cylindrical and opposite ends of said tube means are clamped between said casing and said mounting member.

14. The irrigation system of claim 13 wherein said distributor constitutes a sprayer removably attached at said pulsator outlet.

15. A generally cylindrical elastomeric pulsator tube mounted on a mounting member to define an expansible chamber therein having an inlet and to further define a valve means with said mounting member, said tube, when in its relaxed and pre-installed condition, comprising a cylindrical first portion forming said valve means with its engagement with underlying surface portions of said mounting member, and annular undercut means defined internally on said tube at a lower end of said first portion for maintaining a second portion of said tube essentially in out-of-contact relationship with respect to an underlying portion of said mounting member, said mounting member being in the form of a generally tubular pin comprising an outlet port, having an inlet adapted to communicate with said chamber and an outlet, and wherein said valve means comprises said first portion of said tube that normally engages said pin to cover upstream and downstream sides of the inlet to said outlet port when said tube is in a contracted condition and having sufficient flexibility to disengage said pin at the upstream side of said inlet to uncover the inlet to said outlet port when said tube is in an expanded condition, and an annular flange on said pin defining an annular contracting surface positioned on the upstream side of the inlet to said outlet port and normally engaged in an at least near line contact with the first portion of said tube when said tube is in its contracted condition, and slot means defined radially between said mounting member and said tube to be continuously exposed to said chamber for continuously communicating liquid from the inlet to said chamber to the downstream side of the inlet to said outlet port.

16. The pulsator tube of claim 15, wherein said contacting surface is defined at a major diameter of said flange and further comprising a contiguous non-contacting surface spaced longitudinally from said contacting surface to be continuously exposed to said chamber and defined by a minor diameter at said flange, less than said major diameter, said second portion of said tube being continuously retained in out-of-contact relationship with respect to said non-contacting surface when said tube is in its contracted condition to include a near-instantaneous communication of pressurized liquid from said chamber to the upstream side of the inlet to said outlet port and through said valve means when said tube expands towards its expanded condition to open said valve means.

17. The irrigation system of claim 16 wherein said flange further comprises an at least generally frusto-conically shaped surface between said contacting and non-contacting surfaces.

18. The irrigation system of claim 15 further comprising a casing and wherein opposite ends of said tube are clamped between said casing and said pin.

19. In an irrigation system comprising a source of pressurized liquid, a distributor for discharging said liquid intermittently therefrom and a pulsator connected between said source and said distributor, said pulsator comprising a pulsator inlet for receiving pressurized liquid therein from said source, a pulsator outlet for emitting said liquid in intermittent pulses to said distributor, a casing defining a cavity therein, a mounting member disposed in said cavity, an elastomeric tube means, defining an expansible chamber therein and disposed between said casing and said mounting member, for movement from a normally contracted condition when the pressure of the liquid in said chamber falls below a predetermined level to an expanded condition when the pressure of the liquid in said chamber exceeds said predetermined level, flow control means between said pulsator inlet and said chamber for controlling the flow rate of said liquid into said chamber, valve means, normally closed when said tube means is in its contracted condition and defined between said mounting member and said tube means, for intermittently opening to discharge liquid from said chamber through said pulsator outlet in said intermittent pulses at at least substantially regular frequencies and uniform discharges in response to the pressure of the liquid in said chamber intermittently exceeding said predetermined level, each of said casing and said tube means being generally cylindrical and opposite ends of said tube means being clamped between said casing and said mounting member, and slot means defined radially between said mounting member and said tube means to be continuously exposed to said chamber for continuously communicating liquid from said pulsator inlet to a downstream side of said valve means.

20. In an irrigation system comprising a source of pressurized liquid, a distributor for discharging said liquid intermittently therefrom and a pulsator connected between said source and said distributor, said pulsator comprising a pulsator inlet for receiving pressurized liquid therein from said source, a pulsator outlet for emitting said liquid in intermittent pulses to said distributor, a casing defining a cavity therein, a mounting member disposed in said cavity, an elastomeric tube means, defining an expansible chamber therein and disposed between said casing and said mounting member, for movement from a normally contracted condition when the pressure of the liquid in said chamber falls below a predetermined level to an expanded condition when the pressure of the liquid in said chamber exceeds said predetermined level, flow control means between said pulsator inlet and said chamber for controlling the flow rate of said liquid into said chamber, valve means, normally closed when said tube means is in its contracted condition and defined between said mounting member and said tube means, for intermittently opening to discharge liquid from said chamber through said pulsator outlet in said intermittent pulses at at least substantially regular frequencies and uniform discharges in response to the pressure of the liquid in said chamber intermittently exceeding said predetermined level, and slot means defined in said mounting member to be continuously, openly and directly exposed to said chamber for continuously communicating liquid from said flow control means to an inlet side of said valve means.

* * * * *